US011904205B2

(12) United States Patent
Boddie et al.

(10) Patent No.: US 11,904,205 B2
(45) Date of Patent: Feb. 20, 2024

(54) MAG-LEV LIMB TRAINING DEVICE

(71) Applicant: MY TOTAL SHOULDER, INC., Pembroke, MA (US)

(72) Inventors: Micolene Boddie, Pembroke, MA (US); Blake Sama, Pembroke, MA (US)

(73) Assignee: MY TOTAL SHOULDER, INC., Pembroke, MA (US)

( * ) Notice: Subject to any disclaimer, the term of this patent is extended or adjusted under 35 U.S.C. 154(b) by 185 days.

(21) Appl. No.: 17/533,650

(22) Filed: Nov. 23, 2021

(65) Prior Publication Data

US 2023/0158367 A1 May 25, 2023

(51) Int. Cl.

| | |
|---|---|
| ***A63B 23/12*** | (2006.01) |
| ***A63B 24/00*** | (2006.01) |
| ***A63B 23/035*** | (2006.01) |
| ***A63B 21/00*** | (2006.01) |

(52) U.S. Cl.

CPC ..... *A63B 23/1272* (2013.01); *A63B 21/4017* (2015.10); *A63B 23/03508* (2013.01); *A63B 24/0087* (2013.01)

(58) Field of Classification Search

CPC ..... A63B 23/1272; A63B 21/4017; A63B 23/03508; A63B 21/00192; A63B 22/203; A63B 23/1245; A63B 24/0087; A63B 71/0054; A63B 21/0552; A63B 21/4049; A63B 24/0062; A63B 2071/0072; A63B 2213/00; A63B 2208/0242; A63B 2208/0204; A61H 1/0274; A61H 1/0281; A61H 2201/1215; A61H 2201/5069; A61H 1/0277; A61H 2201/1635; A61H 2201/1642; A61H 2201/1638; A61H 2201/1676; A61H 1/0285; A61H 2205/00

See application file for complete search history.

(56) References Cited

U.S. PATENT DOCUMENTS

| | | | | |
|---|---|---|---|---|
| 2,760,774 | A | 8/1956 | Perez | |
| 3,662,602 | A | 5/1972 | Weiss | |
| 4,089,520 | A | 5/1978 | Ozbey | |
| 4,108,429 | A | 8/1978 | Minichiello | |
| 4,772,015 | A | 9/1988 | Carlson | |
| 4,822,027 | A | 4/1989 | Kascak | |
| 4,944,502 | A | 7/1990 | Collins | |
| 4,944,508 | A * | 7/1990 | Collins | A63B 21/4035 482/121 |
| 5,241,952 | A | 9/1993 | Ortiz | |
| 5,251,644 | A | 10/1993 | Fitzgerald | |
| 5,374,226 | A | 12/1994 | Grahm | |
| 5,391,132 | A | 2/1995 | Greenwald | |

(Continued)

FOREIGN PATENT DOCUMENTS

| | | |
|---|---|---|
| CN | 102292060 | 1/2009 |
| CN | 105559790 | 5/2016 |

(Continued)

*Primary Examiner* — Andrew S Lo
*Assistant Examiner* — Andrew M Kobylarz
(74) *Attorney, Agent, or Firm* — Troutman Pepper Hamilton Sanders LLP (Rochester)

(57) ABSTRACT

A device for training and rehabilitation of a limb is provided. The device provides a board with an ability to magnetically levitate a movement base above the board to allow for controlled movement of a limb or other body part of a user needing training and rehabilitation in various directions.

17 Claims, 5 Drawing Sheets

(56) References Cited

U.S. PATENT DOCUMENTS

| | | | | |
|---|---|---|---|---|
| D361,621 | S | 8/1995 | Johnson | |
| 5,520,615 | A | 5/1996 | Fontana | |
| 5,549,520 | A | 8/1996 | Grahm | |
| 5,645,521 | A * | 7/1997 | Hepburn | A63B 21/4045 482/136 |
| 5,713,370 | A | 2/1998 | Cook | |
| 5,839,991 | A | 11/1998 | Hall | |
| 6,007,500 | A | 12/1999 | Quintinskie | |
| 7,393,310 | B2 | 7/2008 | Andrews | |
| 7,824,317 | B2 | 11/2010 | Nakamura | |
| 8,251,879 | B2 | 8/2012 | Binns | |
| 8,425,437 | B2 | 4/2013 | Zaborowski | |
| 8,545,373 | B2 | 10/2013 | Borden | |
| 8,612,010 | B2 | 12/2013 | Simmons | |
| 9,604,094 | B2 * | 3/2017 | Kosyan | A63B 21/4039 |
| 10,413,778 | B2 | 9/2019 | Boddie | |
| 11,285,360 | B2 * | 3/2022 | Lochhead | A63B 21/4045 |
| 2002/0107116 | A1 | 8/2002 | Schulz | |
| 2003/0028130 | A1 | 2/2003 | Wunderly | |
| 2008/0248927 | A1 | 10/2008 | Ivey | |
| 2010/0234776 | A1 | 9/2010 | Borden | |
| 2011/0230800 | A1 | 9/2011 | Binns | |
| 2011/0300994 | A1 | 12/2011 | Verkaaik | |
| 2011/0319232 | A1 | 12/2011 | Thorpe | |
| 2013/0237393 | A1 * | 9/2013 | Kerdjoudj | A63B 21/4033 482/122 |
| 2013/0284182 | A1 | 10/2013 | Valdez | |
| 2014/0296654 | A1 | 10/2014 | Breen | |
| 2015/0165266 | A1 * | 6/2015 | Powers | A63B 22/16 482/142 |
| 2016/0206923 | A1 * | 7/2016 | Watterson | A63B 22/0214 |
| 2018/0055708 | A1 | 3/2018 | Hatch | |
| 2018/0133546 | A1 * | 5/2018 | Boddie | A63B 21/0552 |
| 2019/0030399 | A1 * | 1/2019 | D'Alesio | A63B 21/4034 |
| 2019/0358489 | A1 | 11/2019 | Boddie | |
| 2021/0197027 | A1 * | 7/2021 | D'Alesio | A63B 26/003 |

FOREIGN PATENT DOCUMENTS

| | | |
|---|---|---|
| WO | 1986003981 | 7/1986 |
| WO | 20140109717 | 7/2014 |

* cited by examiner

MAG-LEV LIMB TRAINING DEVICE

BACKGROUND OF THE INVENTION

Field of the Invention

The present invention relates generally to devices for physical training and rehabilitation. More particularly the present invention relates to a device that controls multiple motions and ranges of motions for the purposes of physical training and/or rehabilitation of a body part or joints of the body part.

Description of Related Art

After many types of injuries, physical therapy is required to restore an injured member to previous capability. Commonly, various exercise devices or activities may be used by the therapist to achieve this restored functionality.

Shoulder injuries and other joint injuries are common injuries treated by therapy. For example, the shoulder joint is very complex and subject to a number of motions, actions, and activities that can cause injury. Because of the complexity of the shoulder and its myriad movements, rehabilitation in a controlled, isolated, and specific manner can often be quite difficult. Other joints have similar complexities relating to rehabilitation and isolation of certain motions. Further, when rehabilitating the shoulder, specific limited movement ranges are generally desired. However, existing treatments at best only estimate these movement ranges.

Therefore, what is needed is a limb rehabilitation device that can specifically control movement ranges in a number of different movement direction with variable to little to no friction.

SUMMARY OF THE INVENTION

The subject matter of this application may involve, in some cases, interrelated products, alternative solutions to a particular problem, and/or a plurality of different uses of a single system or article.

In one aspect, a device for guided body part movement is provided. The device has a board and a base, the base being movable relative to the board. Further, the base has a plurality of magnets such as electromagnets which are operable to have a same polarity as a polarity of the magnet such that the magnet is repelled from at least one of the plurality of electromagnets to levitate the base from the board, the plurality of electromagnets positioned along the board to define a movement path of the base that replicates a body motion.

In another aspect, a method of rehabilitation of a body part is provided. The method involves positioning the body part on a movement base. This movement base is movable along a board of a training device. The device further includes a plurality of magnets such as electromagnets positioned on the board, and a computer controller. The computer controller is operable, upon receipt of an input, to case the movement base to levitate off a surface of the board using the plurality of electromagnets positioned on the board and a magnet on the movement base. The method further involves moving the movement base along a plane parallel to the board while the movement base is levitating off the surface of the board, and in turn moving the body part so as to train and/or rehabilitate the body part.

In various aspects, the base may be movable on a board about a limb's axis or joint's axis of rotation, and/or movement above and/or below the involved joint.

DETAILED DESCRIPTION

Figure 1:
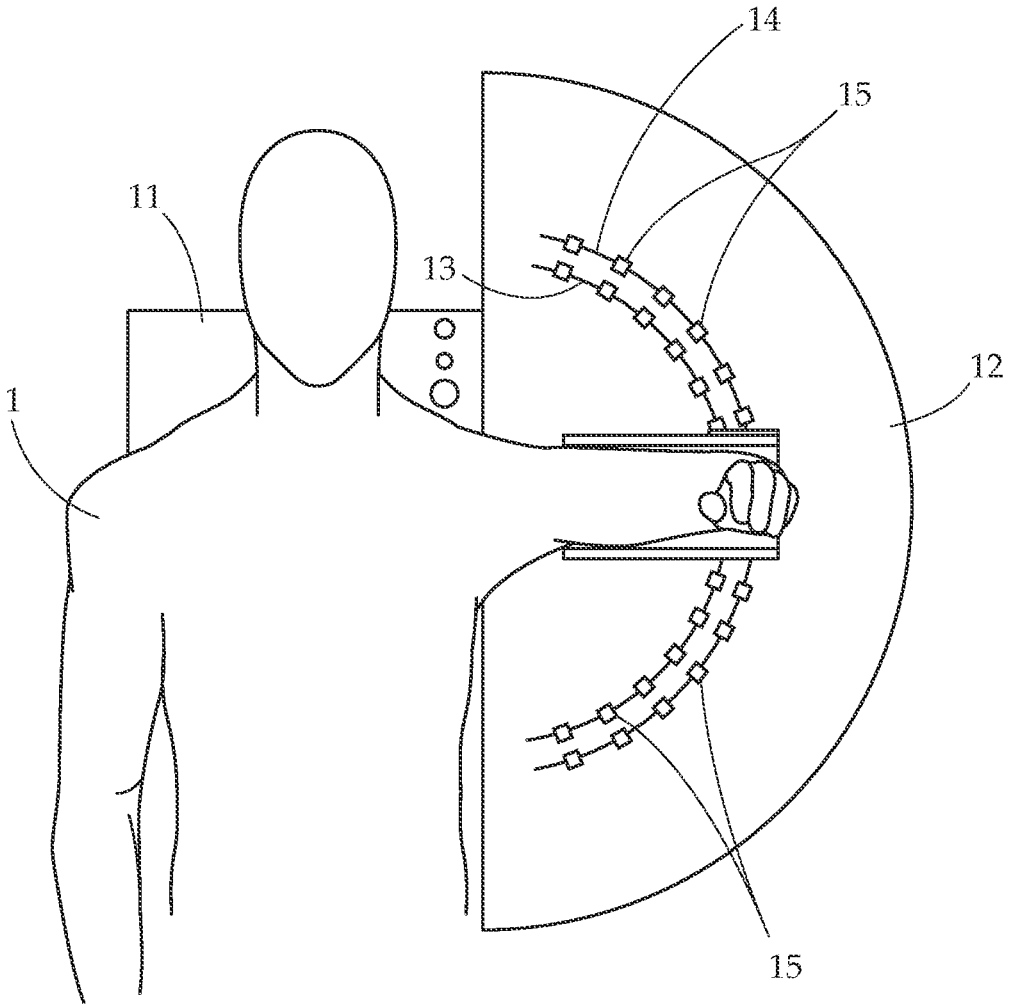
FIG. 1 provides an elevation view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a board that allows controlled and customizable ranges of motion of a limb along a top surface of the board utilizing magnetic levitation of a support base above the board to reduce friction. The present disclosure results in a device which allows the magnetically managed reduction of friction on limb movement during training/rehabilitation. In varying embodiments, the board may utilize pegs, tracks and track limiting pins/pegs, magnetically controlled resistance, or similar blockers or blocking arrangements to limit movement of the limb on the board. Further, tracks may be provided in the board to guide and control proper movement of the limb. The tracks may utilize the magnetic levitation to guide movement in a very reduced or zero friction condition (aside from the pivoting connection to the board. During use, the limb or other body part may be positioned on a base, which may have an optional cradle to support and hold the limb or other body part. The base is, in many embodiment, connected to the board in a pivotable manner, or connected to the axial rotation track, among other options. In other embodiments, the lone engagement of the base with the board is via magnetic engagement to achieve magnetic levitation.

Like poles of magnets repel each other, while opposite poles of the magnets attract. Using this, the limb motion device contemplated herein is able to use magnetic levitation to elevate the base and optional cradle above the board, creating a very low friction condition for movement. Similarly, movement of the levitating base (or other similar structure for supporting a limb or body part for rehabilitation) can be controlled by opposite polarity magnets "pulling" and same polarity magnets "pushing" the object along. Electromagnets allow control of strength and polarity by adjusting the current flow and direction, and thus allow controlled manipulation of the base, and any limb or body part positioned thereon, as it moves along its path in various locations.

In a particular embodiment, the present invention may be used as a shoulder rehabilitation device. In this embodiment, the board, along with controlling blockers and optional tracks, may be used to provide guided limb motion to aid and strengthen shoulder adduction and abduction, among other movements. An arm stabilizer may be movable in limited or free motion on this board. Further, the device may be utilized to aid and strengthen internal and external shoulder rotation, among other movements, in a guided fashion along this track. Further, the movement range may be adjusted and fixed/locked to be at various angles of shoulder adduction or abduction so that rotation (including, but not limited to internal and external rotation) may be aided and strengthened at these various angles.

In some embodiments, a goniometer may be utilized on parts of the present invention to control movement and identify appropriate movement ranges. Further, the goniometer may be controllable to program or set the ranges of motions through which the limb is allowed to move.

In certain embodiments, the goniometer may comprise an electronic alerting mechanism that provides an indication (such as audible, tactile, or visual) when a desired angle has been achieved or reached. Such a goniometer may be programmable depending on a user's training or rehabilitation needs, in some embodiments.

The shoulder-applied embodiment of the present invention may be used when a user is lying flat, standing up, sitting, or in any position in between. Further, the board typically may be parallel to a user's back, but in some embodiments, the board may be angled (+/−90 degrees) towards a user's front or back to adjust an angle of the arm or other body part when being trained on the machine. This may create an angle in a scapular plane or other therapeutic plane of motion. This angling may be achieved by, for example, a hinged or pivoting structure.

As such, the present disclosure provides a highly customizable tool to guide training or rehabilitation of the body. This may be in the form of limb movement in a controlled manner, relative movement of body parts via joint movement, limb movement, torso movement, and the like, and other similar bodily movements. The device is highly customizable to allow for various motions, and ranges of motion so long as at least part of a human body is supported on a base which can then be moved while the base is supported using magnetic levitation. It should be understood that the present disclosure relates to not only shoulder rehabilitation, training, and/or exercise tools, but may be used with any bodily joint and/or limb movement including but not limited to rehabilitation, training, and/or exercise including, but not limited to: neck, collar bone, shoulder, elbow, wrist, fingers and knuckles, arms, torso/spine, hips, legs, knees, ankles, toes, and the like.

The present disclosure may also include a computerized controller operable to activate, deactivate, and otherwise control the plurality of electromagnets to provide the various functionalities of the magnetic levitation system. These may include but are not limited elevation of the base off the board, controlling the electromagnets to cause a controlled movement of the base, and controlling the electromagnets to secure the base in a particular position, among other options. The computer controller may have a microprocessor in communication with a memory which provides instructions to the microprocessor, which in turn provides a signal to one or more of the plurality of electromagnets which can activate and deactivate certain of the electromagnets, and in some cases control a polarity of some or all of the electromagnets. In one embodiment, a user interface allows an operator to select an operational mode based on a set of programmed options which will cause the microprocessor to operate the electromagnets as desired to adjust and customize operation of the device. In a further embodiment, a force gauge may be in communication with the computer controller to measure an amount of force applied to the base by a user, and/or measure an amount of force applied to the base by the magnetic levitation system in any direction including upward force applied and movement force applied along the track.

In one embodiment, the magnetic levitation system having a controlled movement ability by the magnetic levitation using the computer controller may be used for controlled movement during surgical operations. For example, during a surgical procedure, surgeons may require that a limb or limbs be moved during the procedure in a precise manner. In the prior art, operators or support staff had to gently and slowly move the limb manually. This is uncontrolled and can lead to jerky and damaging motions. Using the present disclosure however, a very slow, controlled and precise movement of a limb or body part may be achieved. In a particular embodiment, the system may be configured such one or more limbs and/or one or more portions of a torso may all be positioned on a base which is movable via the magnetic levitation system disclosed herein. In a specific embodiment, each limb and at least one part of the torso may be positioned on a movement base. In such an embodiment, the computer controller may receive an input to move any limb along a movement track to a particular position. Such a configuration need not be limited to a surgical procedure, and may be used in any therapeutic, exercise, medical, or training procedure, as well as other situations without limitation.

One or more sensors may further be in communication with the computer controller which can provide additional information and feedback to the user via the user interface. For example, a goniometer may be connected to the computer controller and a signal provided by the goniometer may be converted to a visual indication of an angle of the base and/or an axial rotation of a limb relative to the board. In other embodiments, force sensors may be used to record an amount of force that is applied by a user on the base and/or an amount of force applied by the magnetic levitation system to the user's limb on the base, depending on embodiment.

Turning now to FIG. 1, an embodiment of a shoulder-implemented version of the present invention is provided. In this view a user 1 is resting on a table 11. To the user's 1 left is a board 12 removably or permanently attached to the table 11. The angle of the board 12 relative to the table 11 may be adjusted, and in this view is parallel with the table. In the view shown, the board 12 has a semicircular shape mimicking the range of motion of the user's humerus in an abduction and adduction shoulder motion. Of course, the board may be formed in any shape without straying from this disclosure. In this embodiment, the board 12 has two rows of electromagnets 15 arranged in arc shapes. Other embodiments may utilize only one row, or more than two rows of electromagnets. Electromagnets 15 are arranged along arc 14 and arc 13 to support the base 16 formed to support an upper arm of the user at two points. In the various embodiments, the plurality of electromagnets are positioned along the board to define or approximately define a movement path of the base that replicates a body motion. Magnets, which may be permanent magnets or, in this embodiment, electromagnets 15, interact with magnets (either permanent or electromagnets) on the base 16. The base 16 may have different sizes and configurations depending on the body part it is meant to support. In the embodiment shown, the board 12 may have a pivotal connection at the proximal end of the base 16. In other embodiments, the base 16 may be engaged with the board 12 only via the magnetic engagement which guides the movement of the base 16 using only the magnetic interaction between electromagnets 15 on the board 12 and magnets in the base 16. Depending on embodiment, the base 16 may be guided by a track formed in or on the board 12, or may be trackless.

In many cases of training or rehabilitation, a limited range of motion is desired so as to not overextend a healing or training joint and corresponding muscles. For example, range of a shoulder motion may be limited to an approximately 30 degree range of motion in both the abducting and adducting direction. Other possible motions include, but are not limited to movements along frontal, sagittal and/or transverse planes. The present disclosure may use any number of structures or options to limit this motion, including a blocking structure such as a peg, tab, clip, clamp, and the like. In another embodiment, a computer controller may be operable to control the electromagnets 15 so that movement of the base 16 is prevented or limited. This can be achieved by, for example, adjusting polarity and field strength by current manipulation to pull and hold the base 16 to the board 12 rather than levitate it. Or in another embodiment, polarity and field strength may be such that repulsive forces are applied in the movement direction to the base 16 to prevent it from moving beyond a predetermined range on the board. For example, electromagnets 15 at a certain degree range of motion in the abducting and/or adducting direction may operate to repel the base 16 from moving over and past them. In varying embodiments, motion limiting of the base 16 may be achieved by the same electromagnets which provide the levitation of the base 16, or different electromagnets.

Figure 6:
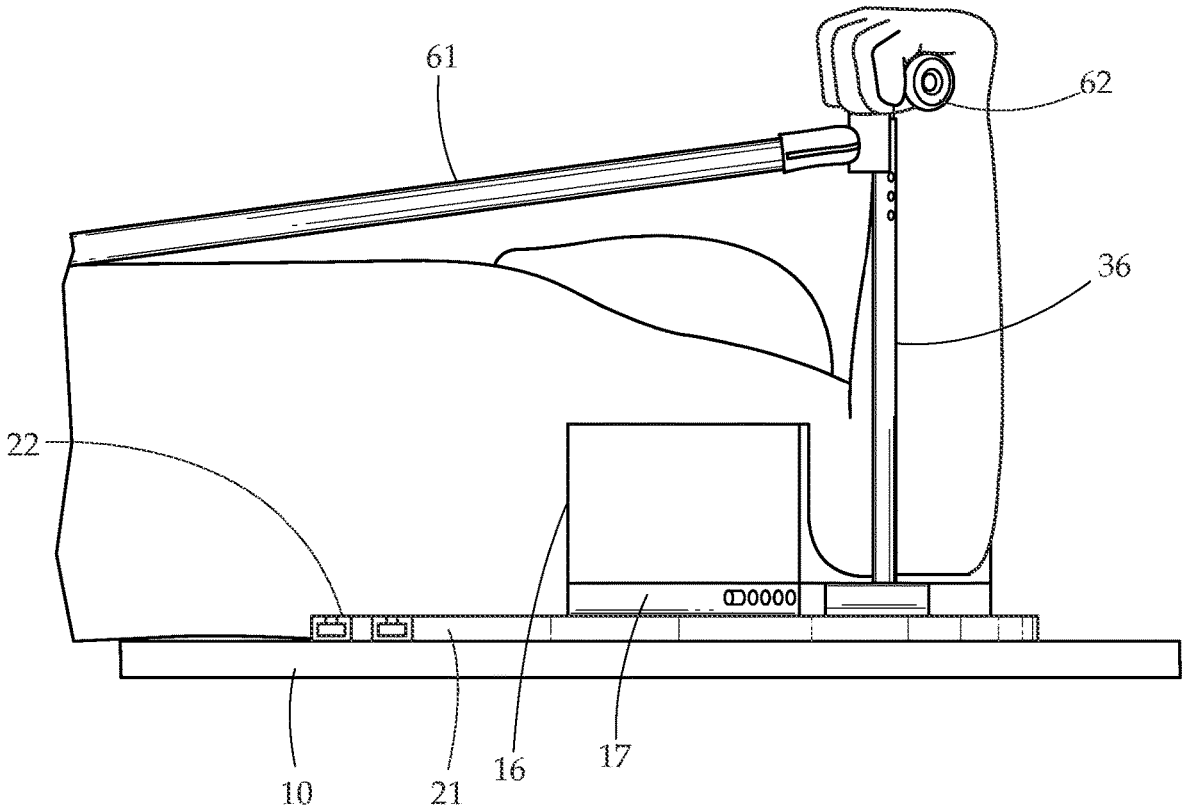
FIG. 6 provides a perspective view of still yet another embodiment of the present invention.

Further, in the embodiment shown in FIG. 1, the user can perform a full 180 degrees of internal and external rotation by a pivoting of an upright shaft (element 36 as seen in FIG. 6) at a distal end of the base. In some embodiments, this pivoting of the shaft may be limited in motion using an electronic controller in communication with the computer controller, or manually using pins, stops, clips, and other physical blocking structures.

Figure 2:
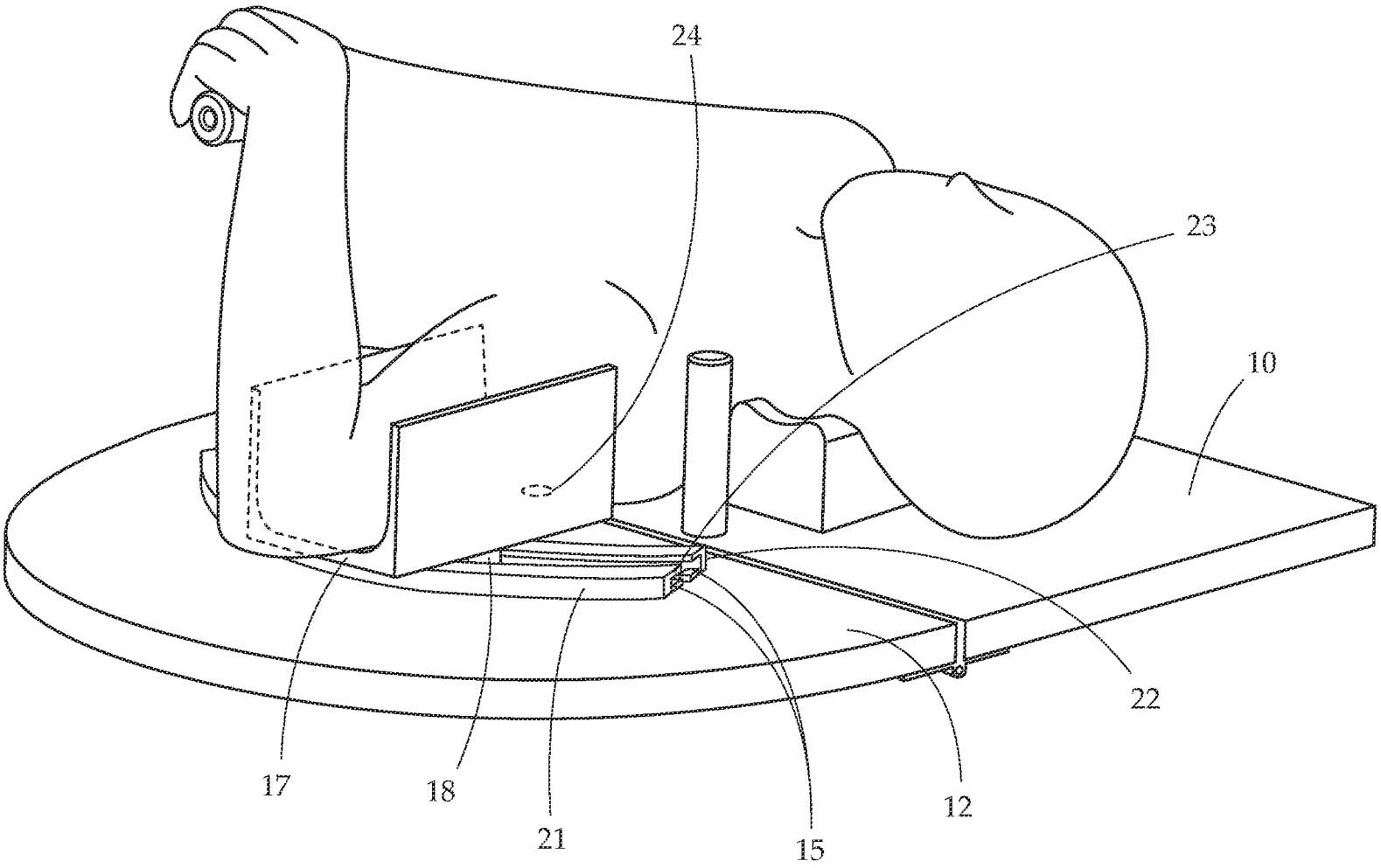
FIG. 2 provides a perspective view of another an embodiment of the present invention.
Figure 3:
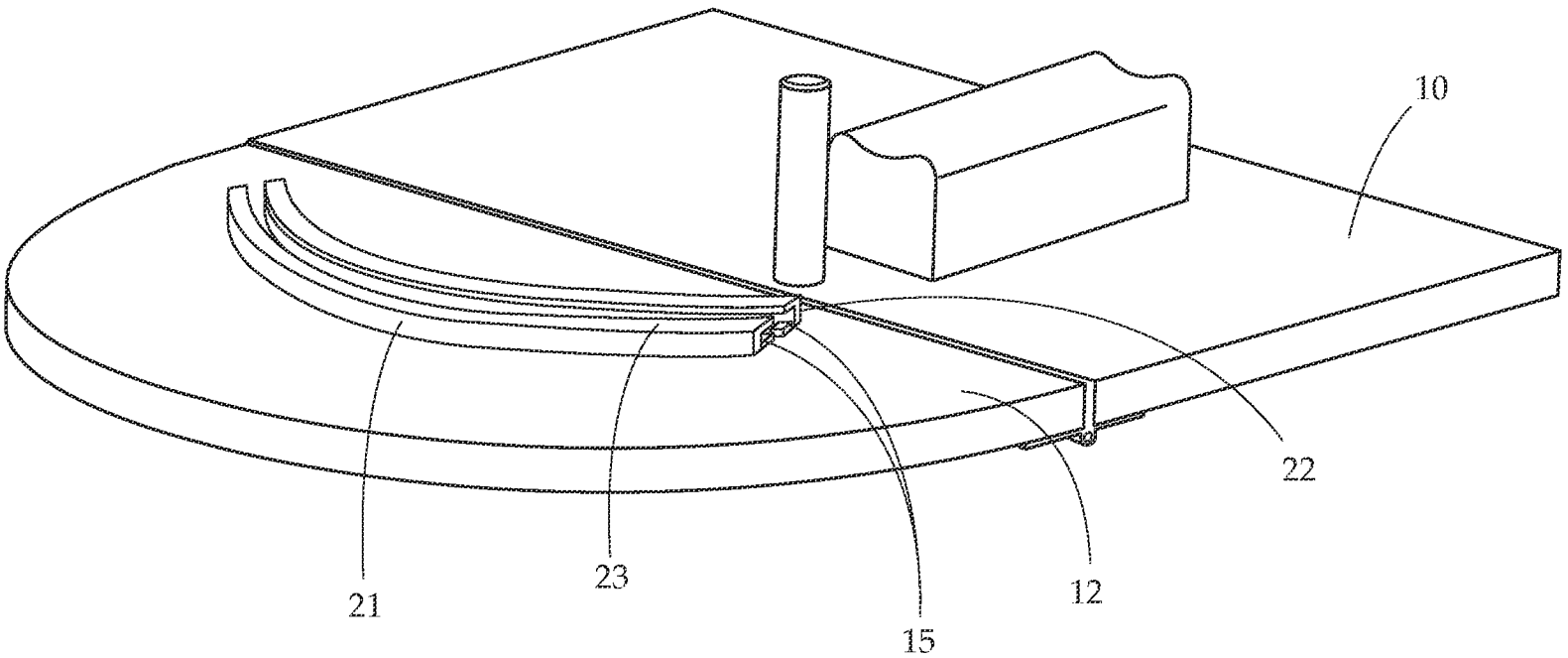
FIG. 3 provides a perspective view of still another embodiment of an arm stabilizer of the present invention.

FIGS. 2 and 3 show views of another embodiment of the present invention in perspective view, with FIG. 3 showing the system with the base 16 removed. As with FIG. 1, the board 12 allows the user's arm on the base 16 to move along its surface guided by tracks 21 and utilizing magnetic levitation. Here, the base 16 includes a pad 17 which has a concave shape to accommodate and cradle an upper arm. Depending on embodiment and intended body part to be used on the training device, the pad 17 may have varying shapes. In this embodiment, a track 21 guides the base 16 motion and supports the magnetic levitation system. The track is formed as two opposing walls 22 each with an inwardly extending flange 23. On each lower edge of the track are two rows of electromagnets 15 spaced along, or continuously extending along the length of the track 21. Base 16 has a track guide 18 having a narrow portion which fits between the opening of the track, and a wider flanged portion which fits within the wider section of the track 21 between walls 22, but which cannot pass through the narrow opening at the top of the track 21 between the flanges 23.

Magnets in the track guide 18 (see FIG. 5) engage with the electromagnets 15 and based on the magnetic interactions can allow the electromagnets 15 to levitate the track guide 18 and in turn the base 16. In another mode of operation of the electromagnets as caused by the computer controller, the magnets of the track guide 18 can be magnetically held in place by causing the electromagnets to have an opposite polarity to those of the track guide 18. When held in position, the device may be used for isometric strengthening. In still another mode of operation, field strength of the electromagnets 15 may be sufficient to urge the track guide 18 flange up against the track flanges 23. In some cases, this upward force may be such that when a weight of a user's body part on the base 16 will push the flanges apart and into a levitating position. In another embodiment, the upward force may be such that it causes an appreciable amount of friction, even with a body part resting on the base 16, such that movement of the base 16 and track guide 18 along the track is limited. In this embodiment, the track 16 is connected to the board 12 at a pivot bearing 24. A shoulder blocker is connected to table 10. The shoulder blocker extends forward and backward towards a top edge of the table to help prevent a user from shrugging the shoulder. In this embodiment, the shoulder blocker is formed having a base 25, shaft 26 which can slide relative to the base 25, and a pad 27. In some embodiments, the shoulder blocker may comprise a spring to apply force and for adjustability.

In operation of this embodiment, a user can move their arm towards a top and bottom end of the board 10 as limited by magnetic control as operated by a computerized controller. Similar to the embodiment of FIG. 1, the user can perform a full 180 degrees of internal and external rotation by a pivoting of an upright shaft (element 36 as seen in FIG. 6). In some embodiments, this pivoting of the shaft may be limited in motion using an electronic controller in communication with the computer controller, or manually using pins, stops, clips, and other physical blocking structures.

Figure 4:
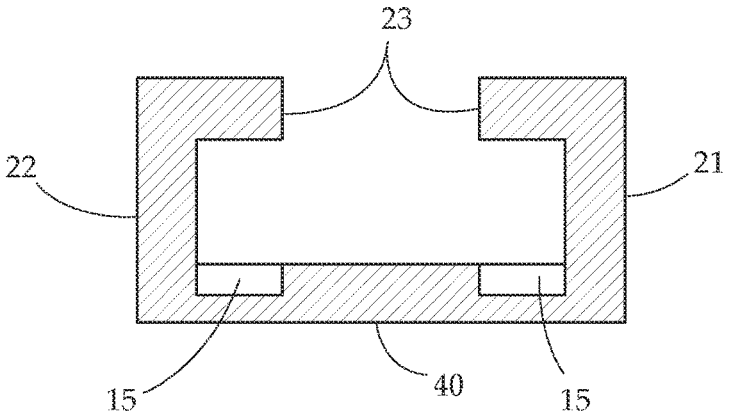
FIG. 4 provides a detail side view of yet another embodiment of the present invention.
Figure 5:
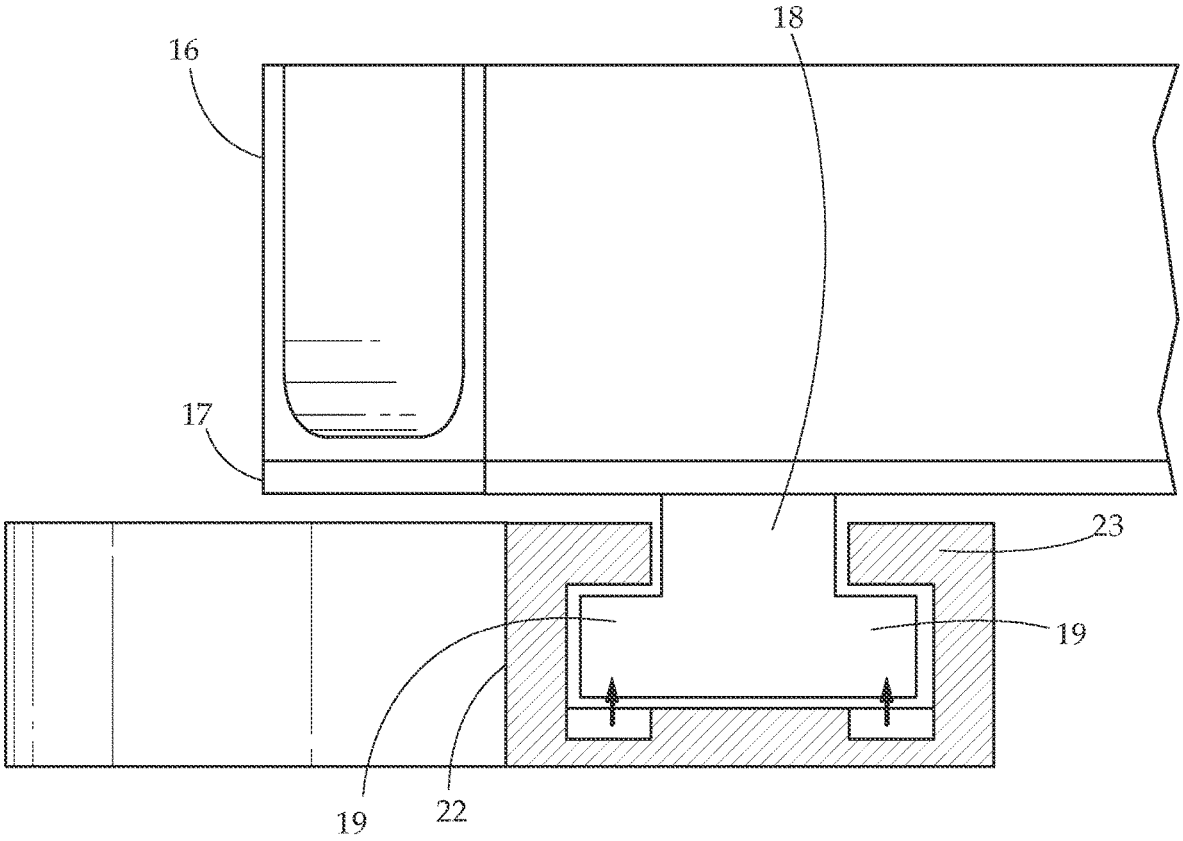
FIG. 5 provides a detail side view of an embodiment of the present invention.

FIGS. 4 and 5 show detailed cross sectional views of an embodiment of the magnetic levitation tracks. FIG. 4 shows an embodiment of the track without the track guide of the base, while FIG. 5 shows track and track guide of the base in place. The track 21 of this embodiment has a bottom surface 40. However, in other embodiments, the board 12 itself may be the bottom surface. Electromagnets 15 are positioned within the bottom surface 15, or in alternative embodiments may rest on the bottom surface 40. In this view, the magnets 15 are positioned on a corner of the track defined by each of the opposing walls and the board. Walls 22 extend from each side, and flanges 23 extend inwardly from a top of each wall 22 towards the opposite wall 22 forming a T-shaped path. Track guide 18 has a narrow portion which fits between the opening of the track, and a wider flanged portion which fits within the wider section of the track 21 between walls 22, but which cannot pass through the narrow opening at the top of the track 21 between the flanges 23. Magnets 19, which may be any type of magnet including permanent or electromagnets, are positioned on the track guide 18. In this view the magnets 19 are on each flange side, but in other embodiments they may be placed anywhere on the track guide. Electromagnets 15 can be activated by current flow to have a same polarity as the magnets 19 to cause a repulsive force between the two, thus levitating the base 16 and a body part thereon to allow for nearly friction-free movement along the track. As noted above, the electromagnets 15 may be manipulated to cause a motion of the base 16 along the track, and or to hold or limit movement of the base 16 along the track. In some embodiments, additional electromagnets may be positioned at other points other than at the bottom, such as on the sides of the walls 22. These side magnets (not shown) may be better suited for causing and limiting movement of the base 16 along the track 21, while the bottom electromagnets 15 are best suited to achieve the levitation of the base 16.

FIG. 6 provides another view of an embodiment of the present invention. In this view, an embodiment similar to that of the other figures is shown. However, in this view a dowel 61 is connected to the upright shaft 36. This upright shaft 36 can pivot about a distal end of the base 16, allowing the user to train internal and external rotation of the shoulder. The dowel 61 may be held by an opposite hand of the user, or by a trainer, healthcare professional, or the like, to urge the arm on the base 16 to move. As shown, the dowel 61 is attached to the shaft 36 near the wrist. However, it should be understood that the dowel 61 may also attach by the elbow, or anywhere else along the shaft 36. The dowel 61 may connect to the shaft 36 in any manner, including a snap fit connection, magnetic connection, and the like. As noted, once connected, a user's healthy arm can move the opposite arm through a range of motion guided by the base 16, shown here as a cradle for an upper arm, by pivoting along the board 12 and, optionally, as limited or moved by the magnetic levitation system as discussed above. In this embodiment, movement of the arm may be abduction/adduction motions, internal/external rotation and/or scapular plane motions, among others. The elbow may be bent or straight as the involved arm or other limb/body part moves or is guided into allowable motion.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A device, comprising:
a board comprising:
a base comprising a first magnet; and
a plurality of magnets operable to have a same polarity as a polarity of the first magnet such that the first magnet is repelled from at least one of the magnets to levitate the base from the board, the magnets positioned along the board to define a movement path of the base that replicates a body motion; and
a track connected to or integral with the board and having opposing walls, wherein the magnets are arranged along a length of the track.

2. The device of claim 1, wherein one or more of the magnets comprise electromagnets.

3. The device of claim 1, wherein the magnets are positioned at a corner of the track defined by each of the opposing walls and the board.

4. The device of claim 1, wherein each of the opposing walls comprises a flange extending from a top of the wall and extending towards the other of the opposing walls.

5. The device of claim 1, wherein the base further comprises a track guide extending from a bottom of the base to engage with the track.

6. The device of claim 5, wherein the first magnet is positioned on the track guide.

7. The device of claim 4, wherein the base further comprises a track guide having a narrow portion at a proximal end which fits between the flanges of the opposing walls and a wide portion at a distal end which fits between the opposing walls, but not between the flanges.

8. The device of claim 2, further comprising a computer controller operable to control a current flow to each of the electromagnets.

9. The device of claim 8, wherein the computer controller is operable to control a direction of current flow of each of the electromagnets to control a polarity of each of the electromagnets.

10. The device of claim 8, wherein the computer controller is operable to control current flow to each of the electromagnets to cause a controlled movement of the base relative to the board.

11. The device of claim 8, wherein the computer controller is operable to control current flow to one or more of the electromagnets to prevent a movement of the base relative to the board.

12. The device of claim 8, wherein the computer controller is operable to control current flow to one or more of the electromagnets to cause the base to levitate off a surface of the board.

13. The device of claim 1, wherein the base further comprises a pad shaped to receive a body part of a user.

14. A device, comprising:
a board comprising:
a base comprising:
a first magnet; and
an upright shaft disposed at a distal end of the base and rotatable along a lengthwise axis of the base to provide internal and external rotation for a shoulder of an arm being stabilized thereon; and
a plurality of magnets operable to have a same polarity as a polarity of the first magnet such that the first magnet is repelled from at least one of the magnets to levitate the base from the board, the magnets positioned along the board to define a movement path of the base that replicates a body motion.

15. A device, comprising:
a board connected on at least one edge to a table, extending away from the table, and comprising:
a base comprising a first magnet; and
a plurality of magnets operable to have a same polarity as a polarity of the first magnet such that the first magnet is repelled from at least one of the magnets to levitate the base from the board, the magnets positioned along the board to define a movement path of the base that replicates a body motion.

16. The device of claim 15, wherein an angle of a top surface of the board with respect to another top surface of the table is adjustable.

17. A device, comprising:
a board comprising:
a base comprising a first magnet;
a plurality of magnets operable to have a same polarity as a polarity of the first magnet such that the first magnet is repelled from at least one of the magnets to levitate the base from the board, the magnets positioned along the board to define a movement path of the base that replicates a body motion; and
a goniometer configured to measure a rotational angle of the base.

* * * * *